US007415833B2

(12) United States Patent
Leaver et al.

(10) Patent No.: US 7,415,833 B2
(45) Date of Patent: Aug. 26, 2008

(54) CONTROL SYSTEM FOR ICEMAKER FOR ICE AND BEVERAGE DISPENSER

(75) Inventors: Daniel C. Leaver, Westmont, IL (US); Thaddeus M. Jablonski, Palatine, IL (US)

(73) Assignee: IMI Cornelius Inc., Glendale Heights, IL (US)

( * ) Notice: Subject to any disclaimer, the term of this patent is extended or adjusted under 35 U.S.C. 154(b) by 181 days.

(21) Appl. No.: 11/199,529

(22) Filed: Aug. 8, 2005

(65) Prior Publication Data

US 2006/0150645 A1 Jul. 13, 2006

Related U.S. Application Data

(60) Provisional application No. 60/599,540, filed on Aug. 6, 2004.

(51) Int. Cl.
*F25C 1/12* (2006.01)

(52) U.S. Cl. ..... 62/74; 62/157; 62/233

(58) Field of Classification Search ..... 62/59, 62/66–74, 135, 157, 233, 340–356
See application file for complete search history.

(56) References Cited

U.S. PATENT DOCUMENTS 4,197,717 A * 4/1980 Schumacher ..... 62/213
4,300,359 A * 11/1981 Koeneman et al. ..... 62/379
4,424,683 A * 1/1984 Manson ..... 62/135
4,475,357 A * 10/1984 Linstromberg ..... 62/157
4,986,083 A * 1/1991 Naruse et al. ..... 62/157
5,063,748 A * 11/1991 Davis et al. ..... 62/59
5,255,526 A * 10/1993 Fischer ..... 62/59

* cited by examiner

*Primary Examiner*—William E. Tapolcai
(74) *Attorney, Agent, or Firm*—Pyle & Piontek, LLC

(57) ABSTRACT

A control system for an icemaker for an ice/beverage dispenser is responsive to both a sensed level of ice in an ice bin of the dispenser and to a customer ice usage profile to operate the icemaker at such times as to build ice for the ice bin just before and in sufficient time and quantity to meet an anticipated demand for ice. The control system may be programmed manually or automatically through use of adaptive algorithms, with ice usage patterns that identify the days and times of day when demands for ice will occur, and the control system then operates the icemaker in accordance with such ice usage patterns.

16 Claims, 10 Drawing Sheets

CONTROL SYSTEM FOR ICEMAKER FOR ICE AND BEVERAGE DISPENSER

This application claims benefit of provisional application Ser. No. 60/599,540, filed Aug. 6, 2004.

FIELD OF THE INVENTION

The present invention relates generally to machines that dispense both beverage and ice, and more specifically to a control scheme for icemakers for such machines.

BACKGROUND OF THE INVENTION

Combination ice/beverage dispensing machines dispense both ice and beverages. Such machines include a plurality of beverage dispensing valves connected to cooled supplies of beverages for dispensing beverages into a cup held below the valves. These dispensers also include an ice retaining bin having an ice dispensing mechanism for delivering ice on demand into the cup. A bin cover is removable from an upper opening to the ice bin to permit access to the bin. In the absence of an icemaker being associated with the ice/beverage dispenser, filling the bin with ice is accomplished by manually lifting and emptying buckets of ice into the bin.

To eliminate difficulties associated with manually filling an ice bin, an icemaker may be mounted above an ice/beverage dispenser to automatically make and introduce ice into the bin. However, the particular icemaker selected can be from one of a number of different manufacturers having various and differently dimensioned footprints that may or may not accommodate direct mounting of the icemaker on top of a given ice/beverage dispenser. In addition, because icemakers are manufactured as separate units from ice/beverage dispensers, the cost of the two units as separately manufactured and mechanically combined is greater than if an ice/beverage dispenser and an icemaker were manufactured as a single unit. Further, as cooling is required in an icemaker to form ice and in an ice/beverage dispenser to cool water for being dispensed into beverages, if a single mechanical cooling system were used for both functions, ice building and water chilling, the capabilities of a combined unit would be leveraged in a cost effective manner. One benefit would be the ability to downsize a cold plate of the ice/beverage dispenser, since water-chilling circuits could be eliminated from the cold plate, resulting in a more compact, less complicated and lower cost cold plate.

Chilling water for dispensing into beverages is typically accomplished in an ice/beverage dispenser by flowing water through a cold plate in heat exchange contact with ice produced by an icemaker. However, using an icemaker to produce ice that is then used to cool and take up heat from a cold plate is inefficient from a thermal and energy standpoint. A typical cube type icemaker evaporator has one side configured and dedicated to molding ice cubes while an opposite side contains refrigerant lines that produce the necessary cooling for removing heat from water flowing over the one side in order to freeze the water and build ice. This arrangement results in only half of the available surface area of the evaporator being used to exchange heat and produce ice. It would be desirable from an economic standpoint to combine an icemaker and an ice/beverage dispenser into a single unit and from a thermal and energy efficiency standpoint to use in such a combined unit the side of the evaporator opposite from the ice cube building side to chill water for use in dispensed beverages.

To maintain an adequate level of ice in an ice bin of an ice/beverage dispenser, according to conventional practice sensors are provided in the bin to detect the level of ice. The sensors generate signals that are indicative of the level and used to control operation of an icemaker in a manner to generally maintain the bin full of ice. So that the icemaker is not cycled excessively, two sensors are usually placed at different levels in the bin. A first sensor is located toward the top of the bin and is at a level such that when it is surrounded by ice the bin is full and a signal is developed by the sensor to turn off the icemaker. A second sensor is located below the first sensor and when it no longer is surrounded by ice it generates a signal to turn on the icemaker. The arrangement is such that when the bin is being filled, the icemaker is operated to introduce ice into the bin until the level of ice reaches the upper sensor, whereupon the upper sensor generates a signal to turn off the icemaker. As ice in the bin is depleted and the level of ice falls away from the upper sensor, the icemaker is not immediately turned on, but instead remains off until the level of ice falls below the lower sensor, whereupon the lower sensor generates a signal to turn on the icemaker. The icemaker then again builds ice and introduces it into the bin until the level of ice in the bin again reaches the upper sensor, whereupon the cycle is repeated. This arrangement works well to maintain the bin generally full of ice, but does not always yield ice of good quality, since at the end of a business day the bin will either be substantially full of ice or will be automatically fully filled with ice, which ice then deteriorates over time as it sits idle in the bin overnight. The result is a bin full of inferior quality ice that is dispensed to customers at the beginning of the next business day.

It would therefore be advantageous to fill of the bin of an ice/beverage dispenser with ice not necessarily in response to a sensed level of ice in the bin, but instead in response to and before an anticipated demand for ice. A benefit to matching the timing of ice production with the time of usage of ice is improved ice quality, since ice would be built just before it is expected to be used, not when it will simply sit idle in the bin and deteriorate over time.

OBJECT OF THE INVENTION

A primary object of the present invention is to provide an improved icemaker control and a method of operating an icemaker for an ice/beverage dispenser, such that building of ice for introduction into an ice retaining bin of the ice/beverage dispenser is controlled to occur in response to an anticipated upcoming demand for ice.

SUMMARY OF THE INVENTION

In accordance with the present invention, an ice making and dispensing system comprises an ice dispenser having an ice retaining bin and means for sensing the level of ice in the bin; an icemaker for making and introducing ice into the bin; and a control system responsive to the sensed level of ice in the bin and to a demand for ice being provided by an ice usage profile of the ice dispenser, wherein the demand for ice is representative of an anticipated upcoming usage of ice from the ice dispenser, to operate the icemaker, if and as necessary, to introduce into the bin sufficient ice to meet the anticipated upcoming usage of ice.

The ice usage profile may provide demands for ice in accordance with days and times of day when usage of ice is anticipated to occur and the control system is responsive to the sensed level of ice in the bin and to demands for ice provided by the ice usage profile to operate the icemaker, if and as necessary, to introduce into the bin sufficient ice to meet anticipated usages of ice at such days and times of day. The control system may be manually programmed to include the ice usage profile, and the system can include means for monitoring actual usage of ice from the ice dispenser, in which case the ice usage profile is responsive to the monitoring means to adaptively change in response to changes in the monitored actual ice usage from the ice dispenser.

The control system, in response to sensing that the bin is full of ice and irrespective of any demand for ice then being provided by the ice usage profile, turns the icemaker off if the icemaker is then being operated to introduce ice into the bin or, if the icemaker is already off, maintains the icemaker off. The control system also, in response to sensing that the bin is less than full but contains at least a predetermined minimum level of ice and in the absence of a demand for ice then being provided by the ice usage profile, again turns the icemaker off if the icemaker is then being operated to introduce ice into the bin or, if the icemaker is already off, maintains the icemaker off. However, in response sensing that the bin is less than full of ice and to a demand for ice then being provided by the ice usage profile, the control system operates the icemaker to introduce ice into the bin. In addition, the control system, in response to sensing that the bin contains less than a predetermined minimum level of ice and in the absence of a demand for ice then being provided by the ice usage profile, operates the icemaker to introduce ice into the bin until the bin is filled with ice to the predetermined minimum level.

The invention also contemplates a method of operating an ice dispensing system that includes an ice dispenser having an ice retaining bin and an icemaker for introducing ice into the bin. The method comprises the steps of sensing the level of ice in the bin; generating an ice usage profile for the ice dispenser, the ice usage profile providing demands for ice that are representative of anticipated upcoming usages of ice from the ice dispenser; and operating the icemaker, if and as necessary, in response to a demand for ice being provided by the ice usage profile, to introduce into the bin sufficient ice to meet the anticipated upcoming usage of ice.

The generating can step comprise generating an ice usage profile that provides demands for ice representative of days and times of day when usage of ice from the ice dispenser is anticipated occur, with the operating step then operating the icemaker, if and as necessary, in response to demands for ice provided by the ice usage profile, to introduce into the bin sufficient ice to meet the anticipated upcoming usages of ice at such days and times of day. The generating step may comprise manually generating the ice usage profile, and further contemplated is the step of monitoring actual usage of ice from the ice dispenser, in which case the generating step is responsive to the monitoring step to adaptively change the ice usage profile in accordance with the monitored actual usage of ice.

In response to the sensing step sensing a level of ice in the bin indicating that the bin is full of ice and irrespective of any demand for ice then being provided by the ice usage profile, included is the step of controlling the operating step to turn the icemaker off if the icemaker is then being operated to introduce ice into the bin or, if the icemaker is already off, to maintain the icemaker off. In response to the sensing step sensing that the bin is less than full of ice but contains at least a predetermined minimum level of ice and in the absence of a demand for ice then being provided by the ice usage profile, included is the step of controlling the operating step to turn the icemaker off if the icemaker is then being operated to introduce ice into the bin or, if the icemaker is already off, to maintain the icemaker off. Also, in response to the sensing step sensing that the bin is less than full of ice and to a demand for ice then being provided by the ice usage profile, included is the step of operating the icemaker to introduce ice into the bin. In addition, in response to the sensing step sensing that the bin contains less than a predetermined minimum level of ice and in the absence of a demand for ice then being provided by the ice usage profile, included is the step of operating the icemaker to introduce ice into the bin until the bin is filled with ice to the predetermined minimum level.

The foregoing and other objects, advantages and features of the invention will become apparent upon a consideration of the following detailed description, when taken in conjunction with the accompanying drawings.

DETAILED DESCRIPTION

Figure 1:
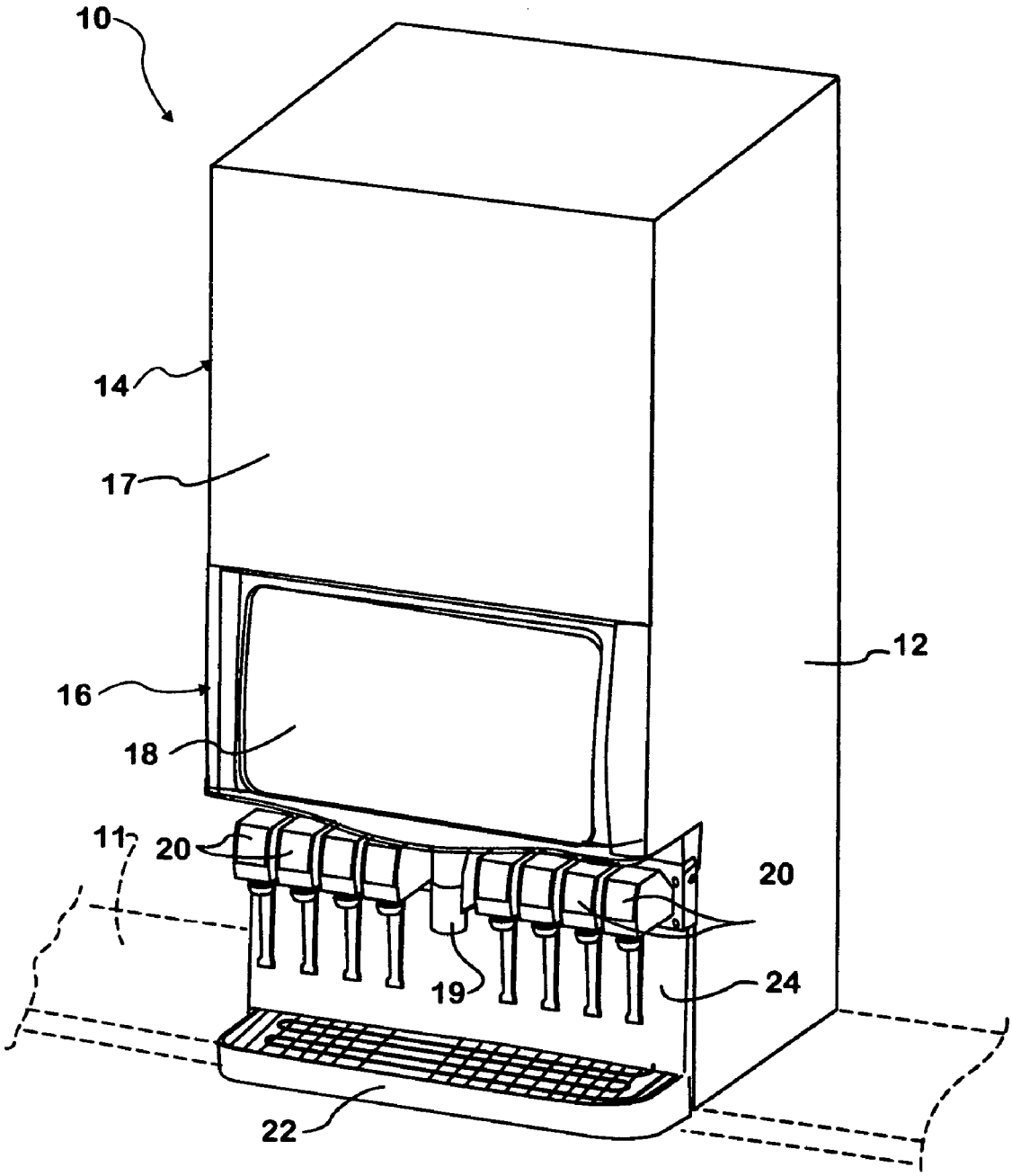
FIG. 1 is a perspective view of a combined icemaker and ice/beverage dispenser machine of a type with which the present invention may be used.
Figure 2:
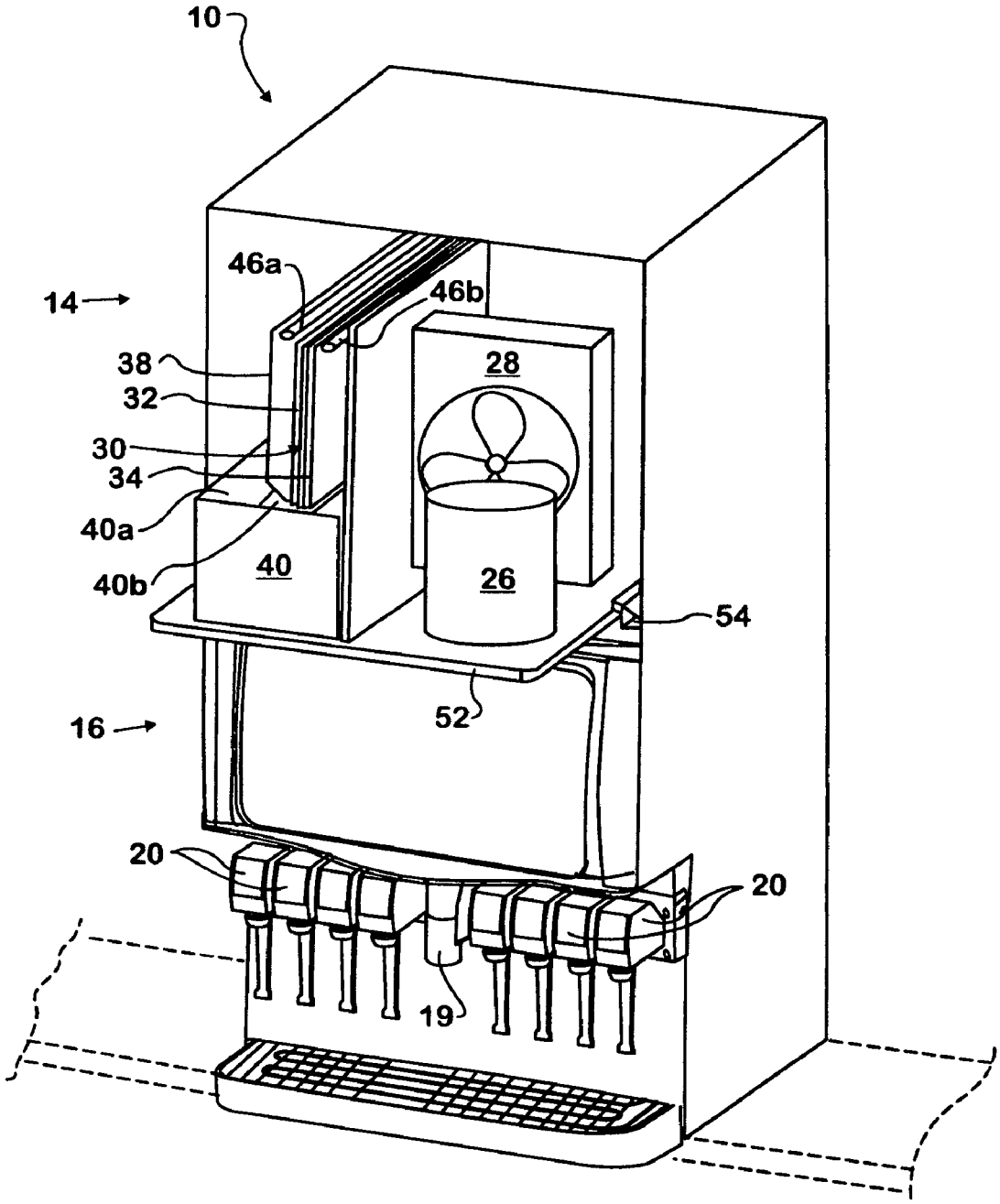
FIG. 2 is a cutaway perspective view of the icemaker and ice/beverage dispenser.

The invention provides a novel icemaker control that is particularly adapted for use with a combination icemaker and ice/beverage dispenser unit. The combination unit may be two separate machines with the icemaker being mounted atop the ice/beverage dispenser, but advantageously the icemaker and ice/beverage dispenser are combined into a single machine and the invention will be described as being embodied in a single unit. The icemaker control of the invention operates the icemaker to build and introduce ice into an ice retaining bin of the ice/beverage dispenser in response to both a sensed level of ice in the bin and to an anticipated upcoming demand for ice, rather than solely in response to a sensed level of ice in the bin. While the invention will be described as being embodied in and used with a combination icemaker and ice/beverage dispenser, the icemaker control could just as readily be used to control an icemaker associated with an ice dispensing machine that does not have beverage dispensing capability.

An advantage to combining an icemaker and an ice/beverage dispenser in a single machine is that since both the icemaker and ice/beverage dispenser require cooling, benefits may be obtained by using a mechanical refrigeration system of the icemaker to both build ice and chill water for dispensing in beverages. Using the mechanical cooling system for both functions leverages the capabilities of the machine in a cost effective manner. One benefit of such a combination is the ability to downsize a cold plate of the ice/beverage dispenser through elimination of water-chilling circuits, resulting in a more compact, less complicated and lower cost cold plate. Another benefit is that since the compressor performs double duty, it is required to run more continuously, reducing the number of start/stop cycles of the compressor and leading to a decrease in wear and tear on compressor components and increased service life. If desired, variable speed compressor technology can be employed to allow for relatively precise matching of compressor capacity to ice-making and water chilling needs.

So that the icemaker can both build ice and chill water for dispensing, a water chilling plate is provided on one side of the evaporator, opposite from an ice building plate on the other side, and water is sprayed onto both sides of the evaporator, doubling its effective water cooling surface area and significantly increasing the saturated evaporator temperature, thereby increasing cooling capacity. Water is recirculated from a collection pan or sump located below the evaporator to the top of the evaporator plates for chilling as it flows down the plates and back into the sump, with the sump being of sufficient size to minimize the tendency for a fixed displacement compressor to cycle on/off. The sump should be large enough to accommodate a time interval of anywhere from 1 to 5 minutes of "on" time of the compressor for a water chiller function, while ice-making normally occurs over a 12 to 15 minute compressor operating cycle.

An estimate is made of maximum demand to be placed on the icemaker to determine the appropriate compressor and sump capacity as well as the lead time for implementation of the ice building control scheme prior to an anticipated period of peak demand for ice, to ensure that an adequate supply of ice is available to meet demand. For example, if a drink specification of 4×12 oz drinks per minute for up to 120 or more drinks per hour is assumed, that can be used to set the maximum consumption rate for cold drinks during periods of peak demand. A particular ice production rate would then set the remainder of the demand for mechanical cooling. Peak demand is based upon that which might be expected in a store setting.

Combining an icemaker and an ice/beverage dispenser and utilizing the icemaker evaporator to both build ice and chill water yields energy savings over the conventional practice of having separate ice-making and water chilling functions. The compressor in the ice-making mode is less efficient than when used to chill water. That means that the energy required to chill the water directly with a mechanical cooling system is less than would be required to make ice for a cold plate. The difference is a result of the saturated evaporating temperature that the compressor will see during ice making, which may be close to 0° F. for ice making, but is closer to 20° F. for water chilling.

Referring to the drawings, a combined ice making and ice and beverage dispensing machine incorporating the above generally described features and of a type with which the teachings of the invention may be used is seen in FIG. 1 and indicated generally at 10. The dispenser 10 is designed to rest on a countertop 11 or other suitable surface and includes an outer housing 12 that encloses an upper ice making portion 14 and a lower ice and beverage dispensing portion 16. The ice making portion includes a removable front panel 17 and the ice and beverage dispensing portion includes a merchandising cover 18, an ice dispensing chute 19, a plurality of post-mix beverage dispensing valves 20, a drip tray 22 and a splash panel 24.

As seen in FIGS. 2-4, 4A, 4B, 6 and 9, the upper ice making portion 14 includes an icemaker comprising a refrigeration system having a compressor 26, a condenser 28 and an ice making and water cooling evaporator, indicated generally at 30. The evaporator 30 has on one side an ice cube forming panel 32 defining a plurality of cubic recesses 32*a* and on an opposite side a water cooler consisting of a flat metal plate 34. An evaporator refrigerant coil 36 is between and in intimate heat exchange contact with the ice cube forming panel 32 and the water cooling plate 34. An ice harvest indicating curtain 38 is pivotally coupled to and extends over the ice cube forming panel 32 for being moved and pivoted clockwise (as viewed in FIGS. 2 and 3) by ice falling off of the panel during an ice harvest cycle to indicate that ice has been successfully harvested. A water holding pan or sump 40 is below the evaporator 30 and includes a partial top cover 40*a* having an opening 40*b* that is located directly below the evaporator. A valve 42 regulates filling of the sump 40 with potable water from a water supply line 43 and a pump 44 circulates water from the sump to a pair of elongate water distribution tubes 46*a* and 46*b*. The tube 46*a* is above and extends along the ice cube forming panel 32 and the tube 46*b* is above and extends along the beverage water chilling plate 34. Each tube has a plurality of linear spaced outlet holes 47 for emitting water for distribution over the surfaces of the ice cube forming panel and the water cooling plate. A valve 48 controls delivery of water to the distribution tube 46*b* and a valve 49 regulates removal of water from the sump 40 through a drain line 49*a*. A divider panel 50 isolates the sump 40 from air circulation around the compressor 26 and the condenser 28. The foregoing components are carried on a deck 52 that is received along opposite edges in slides 54 fastened to inside surfaces of the housing 12, so that the deck may be slid out of the housing to accommodate convenient access to the components.

Figure 3:
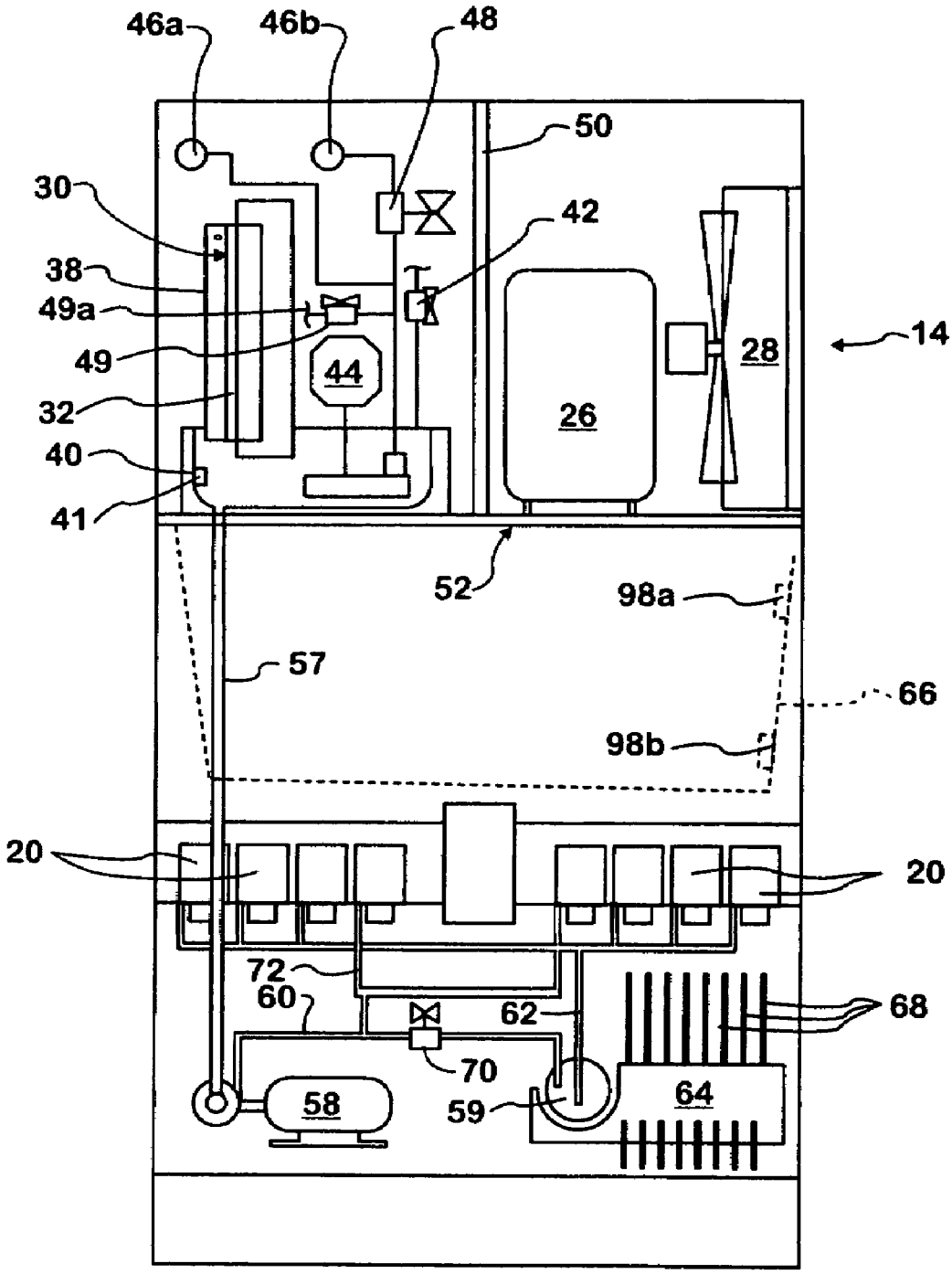
FIG. 3 is a schematic view of the icemaker and ice/beverage dispenser.
Figures 4, 4A, 4B:
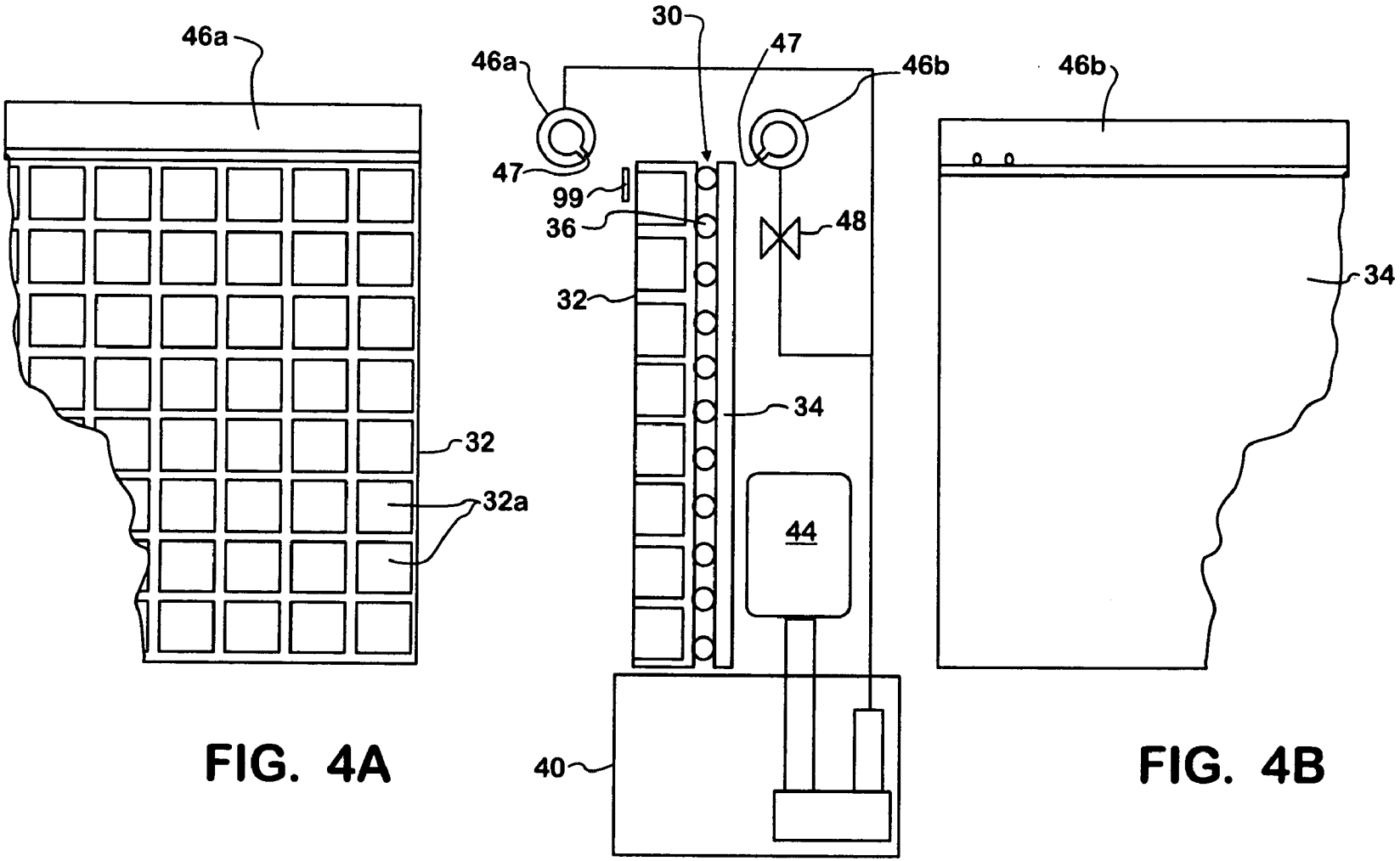
FIG. 4 is a schematic view of a two sided evaporator, a sump for servicing the evaporator and related components of the icemaker and ice/beverage dispenser.
FIG. 4A is a view of an ice cube forming panel on one side of the evaporator.
FIG. 4B is a view of a beverage water cooling plate on an opposite side of the evaporator.
Figure 9:
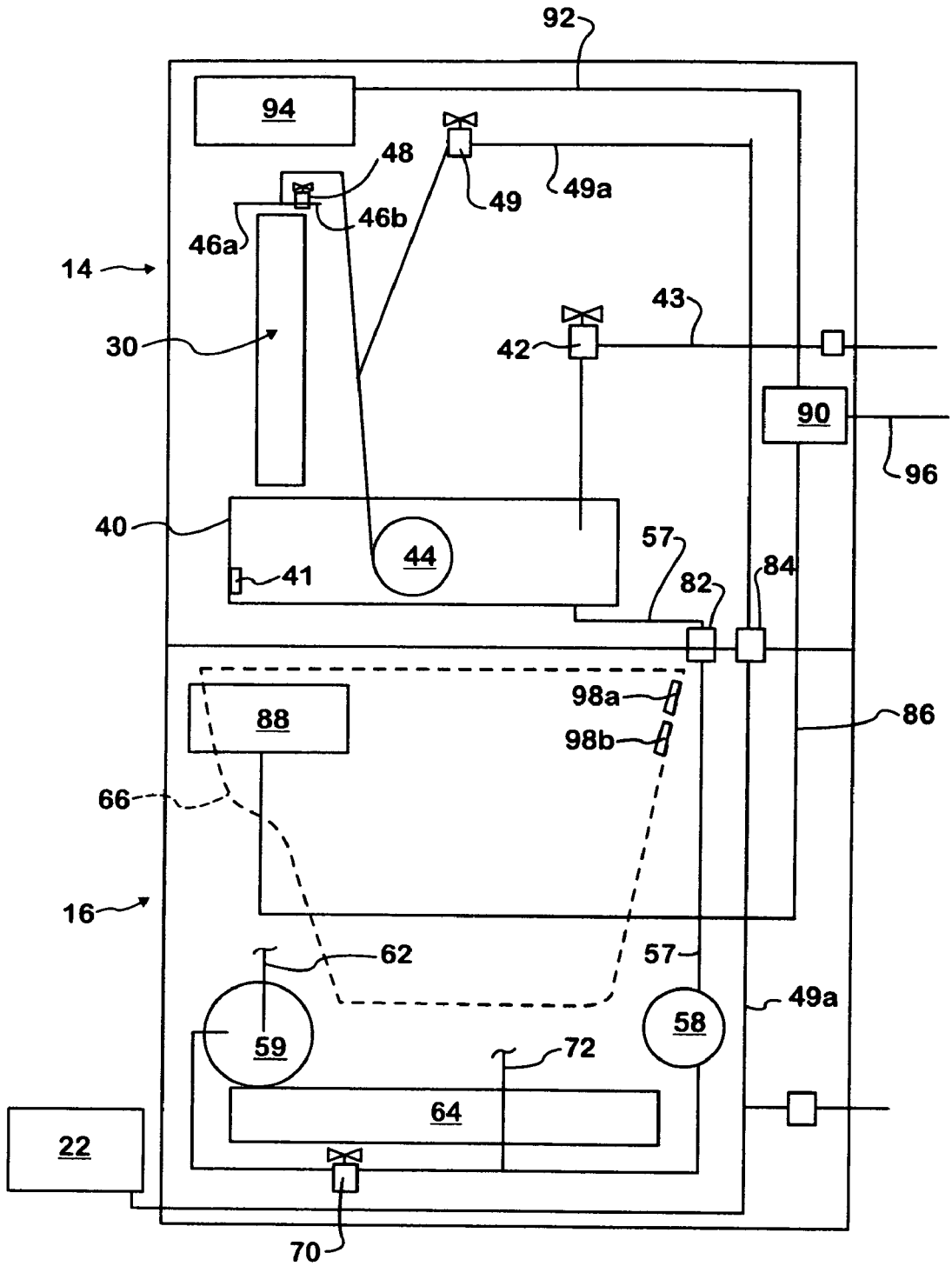
FIG. 9 is a schematic representation of the machine.

As seen in FIG. 3, a fluid line 57 connects the sump 40 with a carbonator pump 58 that connects to a carbonator 59 through a fluid line 60. Carbonated water is produced in the carbonator in a conventional manner and is delivered to the beverage dispensing valves 20 through fluid lines 62. So that chilled carbonated water might be delivered, the carbonator is preferably supported in heat exchange contact with a cold plate 64. As seen in FIG. 9, the dispenser 10 includes an ice retaining hopper or bin 66 located in the lower ice and beverage dispensing portion 16 above the cold plate 64 and below the evaporator ice piece forming panel 32 for receiving ice produced by the panel and gravitationally conveyed to the bin during an ice harvest cycle. The ice bin has a lower opening (not shown) that accommodates gravity passage of ice from the ice bin to, onto and into heat exchange contact with the cold plate 64. Ice from the ice bin automatically falls down onto and cools the cold plate, which in turn cools beverage syrup flavoring flowing through a plurality of circuits or lines 68 embedded in the cold plate. Upon exiting the cold plate, the lines 68 connect to the valves 20 to deliver chilled beverage syrup flavorings to the valves. A valve 70 regulates delivery of water by the pump 58 to the carbonator 59 and one or more water diverting lines 72 are optionally provided to deliver noncarbonated plain water to a selected one or more of the valves 20, for example to two valves (FIG. 3) for use in dispensing beverages that use plain water in mixture with their respective concentrate flavoring syrup.

FIGS. 6-9 show a system for conveniently providing fluid and power connections between the upper ice making portion 14 and the lower ice and beverage dispensing portion 16. The lower portion 16 includes a U-shaped tray 80 positioned at a top and back end thereof to which is secured a water drain line barb fitting 82 and a water inlet flare fitting 84 and through which extends a power cord 86. A lower side of the barb fitting 82 provides for quick connection to and disconnection from the drain line 49*a* and a lower side of the flare fitting 84 provides for quick interconnection with the tube 57 extending between the sump 40 and the carbonator pump 58. The power cord 86 connects at one end to an electrical box 88 and at an opposite end to a power junction box 90. A further power cord 92 extends from the junction box 90 and provides power to a power and control box 94 of the ice making portion 14. A power supply cord 96 connects the junction box 90 to an outside electrical power source.

A processor based electronic control, such as a microprocessor or CPU based electronic control, for the dispenser 10 is located in the junction box 94 and controls operation of various components of the dispenser. The dispenser operates to make ice by circulation of water over the ice cube making panel 32 of the evaporator 30 by the pump 44 while the evaporator is cooled by operation of the compressor 26 of the refrigeration system to freeze the water and build ice on the ice making panel. Ice is harvested when a sensor 99 detects that ice on the panel 32 is of sufficient thickness. Harvest of the ice is effected by a hot gas defrost of the evaporator tube 36, so that the ice is released from the panel for gravity conveyance into the ice retaining bin 66. As ice falls off of the panel it contacts and moves or pivots the harvest indicating curtain 38 to an open position. The curtain 38 then swings back to its resting position upon completion of ice harvesting and closes a switch (not shown) to signal the control circuit that a further ice making cycle can commence. One or more bin ice level sensors, such as an upper sensor 98*a* and a lower sensor 98*b*, are located at selected levels in the ice bin 66 and to detect the level of ice in the bin by detecting the presence or absence of ice thereat. In a conventional mode of operation, the control circuit can be operated to be responsive solely to the sensed levels of ice in the bin to control the icemaker to make ice if the sensed level of ice is low or to stop making ice if the sensed level indicates that the bin is full. In a mode of operation in accordance with the teachings of the invention, the control circuit is operated both in response to the sensed levels of ice in the bin and in response to an anticipated ice usage profile of the dispenser, such that ice is made for the ice bin in response to an anticipated demand for ice, but not solely in response to a low level of ice in the bin.

In operation of the ice making portion 14 to both chill water for dispensing into drinks and to build ice for the ice retaining bin 66, water from the sump 40 is flowed over both the ice cube forming panel 32 and the water chilling plate 34 of the evaporator 30 while the compressor 26 operates to chill the evaporator refrigerant coil 36. To provide the water flow, the pump 44 is operated to flow water from the sump 40 to and out of the water distribution tube 46*a* and across the ice cube forming panel 32 and the valve 48 is opened to flow water to and out of the water distribution tube 46*b* and across the flat water chilling plate 34. The water is chilled by the mechanical refrigeration system as it flows across opposite sides of the evaporator and returns to the sump 40 from which it is withdrawn, as needed, by the carbonator pump 58 to provide either non-carbonated water or to produce carbonated water for use as diluents that are mixed with concentrate syrup flavorings in dispensed beverages.

To generally determine when ice is to be made and when water is to be chilled, lower and upper control temperature set points are selected for water in the sump 40, the temperature of which is detected by a sensor 41. In response to a rise in sump water temperature to a user adjustable upper set point, such as to 38° F., a change is made from ice building to water chilling. While in the water chilling mode, the average temperature of water in the sump 40 should drop at a reasonable rate, so that ice building can resume. However, care must be taken to avoid freezing the water in the sump, so a lower but above freezing set point cut-out temperature is selected for the water in the sump, such as 34° F., at which point the water chilling function ends and any necessary ice building commences.

The sump 40 must be sufficiently sized relative to the size of the carbonator tank 59 to be able to meet demands for chilled water. Whenever the carbonator pump 58 draws a differential volume of water from the chilled water sump 40, warm replacement water enters the sump and elevates the temperature of the water in the sump. If drinks are drawn at an assumed rate of 4×12 oz drinks per minute, the system should not switch to water chilling mode after just one drink is dispensed, but it would be acceptable for the system to switch to water chilling mode toward the end of the second drink. Based upon that criterion, the capacity of the water sump 40 should be approximately 21.3 times the differential volume over which the carbonator tank 59 operates. If the carbonator tank is designed so that when 18 oz of carbonated water has been drawn from it the carbonator pump 58 will turn on and refill the carbonator tank, then the sump size or capacity would be 3.0 gal or 384 oz. The temperature of the water in the sump 40 will rise each time the carbonator pump comes on, by an amount determined by the temperature of the incoming replacement water and the volume of water withdrawn from the sump by the carbonator pump, and if the size of the sump is too small, the jump in temperature will become significant, being roughly inversely proportional to a reduction in size of the sump.

As drinks are drawn from the dispenser 10, water flowing into the sump 40 to replace that which is withdrawn, causes the temperature of the water in the sump to rise until it reaches the upper set point temperature. When this occurs, and subject to the stage of any then ongoing ice making cycle, the processor based control circuit turns on the compressor 26 and the pump 44 and opens the valve 48 to supply water from the sump to and across opposite sides of the evaporator 30 to chill the water in the sump. Two variables determine the rate at which the temperature of the water in the sump drops: the size of the sump (a greater capacity slows the rate of temperature drop) and the capacity of the compressor (a larger capacity increases the rate of temperature decline). This relationship should be controlled and it has been estimated that a compressor capacity in the range of about 9,350 Btu/hr to 13,200 Btu/hr should be proper for a sump capacity on the order of about 3.0 gallons. With the foregoing relationship, a decline in sump water temperature during water chilling and when no drinks are being drawn will be approximately 6.3° F. per minute. Should the carbonator tank repeatedly fill during water chilling, the temperature of the water will rise during each carbonator tank filling, but the overall temperature will trend downward. Cooling capacity needs to be sufficient to pull sump water temperature down to the lower set point temperature in 1 to 5 minutes, so that any necessary ice building can commence. Water chilling takes priority over ice building, so while the sump water temperature remains above the lower cutout temperature, water chilling will continue and ice building will be prevented from occurring.

To compensate for a wide variety of drinks and drink sizes, it is desirable to return to the ice making mode as soon as practical without short cycling the compressor 26. Advantageously, the compressor 26 is a variable speed compressor that can be controlled to accomplish the desired quick return to ice-making. Two criteria may be used to determine if the compressor is running with sufficient capacity. First, if drinks are not being drawn, during water chilling the temperature of water in the sump 40 should be dropping at a rate of between 5 and 10° F. per minute. If not, the compressor speed can be incremented upward, perhaps by about 10%. Second, if drinks are being drawn then a rolling average of 12 readings, one every 5 seconds over a period of 60 seconds, can be used to establish a temperature trend line. The trend line should show that the temperature is decreasing at a rate of at least about 0.7° F. per minute. If it is not or is trending upward, a more significant increase in compressor speed, perhaps by about 20%, can be made. The results of compressor speed changes are not sensed immediately, so it is contemplated that time be allowed following compressor speed adjustments for changes to be seen, perhaps up to 60 seconds, before any further adjustment is made. It is understood that compressor speed adjustments can also be made in the opposite direction to decrease compressor speed.

In accordance with the invention, the icemaker in the ice making portion 14 of the dispenser 10 interacts with the ice/beverage dispenser in the lower beverage dispensing portion 16 such that the building of ice by the icemaker is matched to the demand for ice from the ice/beverage dispenser. As compared to conventional icemaker and ice/beverage dispenser combinations, which generally rely on sensed levels of ice in an ice bin to operate the icemaker to keep the bin full of ice, the invention contemplates controlling the icemaker so that ice is supplied by the icemaker in accordance with anticipated demands for ice from the ice/beverage dispenser. Advantages of the invention are energy savings for a user, such as a store owner, better quality ice and reasonable assurance that ice will always available.

The processor based electronic control in the control box 94 monitors ice usage patterns and develops an icemaker control scheme that anticipates periods of peak ice usage, builds ice for the ice bin in advance of the periods of peak usage and adapts to usage patterns that are learned over time. For example, by monitoring the number of drinks dispensed the electronic controls keep track of usage patterns. A store usage profile that describes the normal usage patterns can then be developed and used as a basis for a demand-based ice building function that makes sufficient ice to meet demand, but does not overproduce ice. As ice usage patterns shift over time, the profile is adjusted by the processor based electronic control through the use of adaptive algorithms, thereby to continue to operate the icemaker in a manner to anticipate and prepare for changing periods of peak demand.

Figure 10:
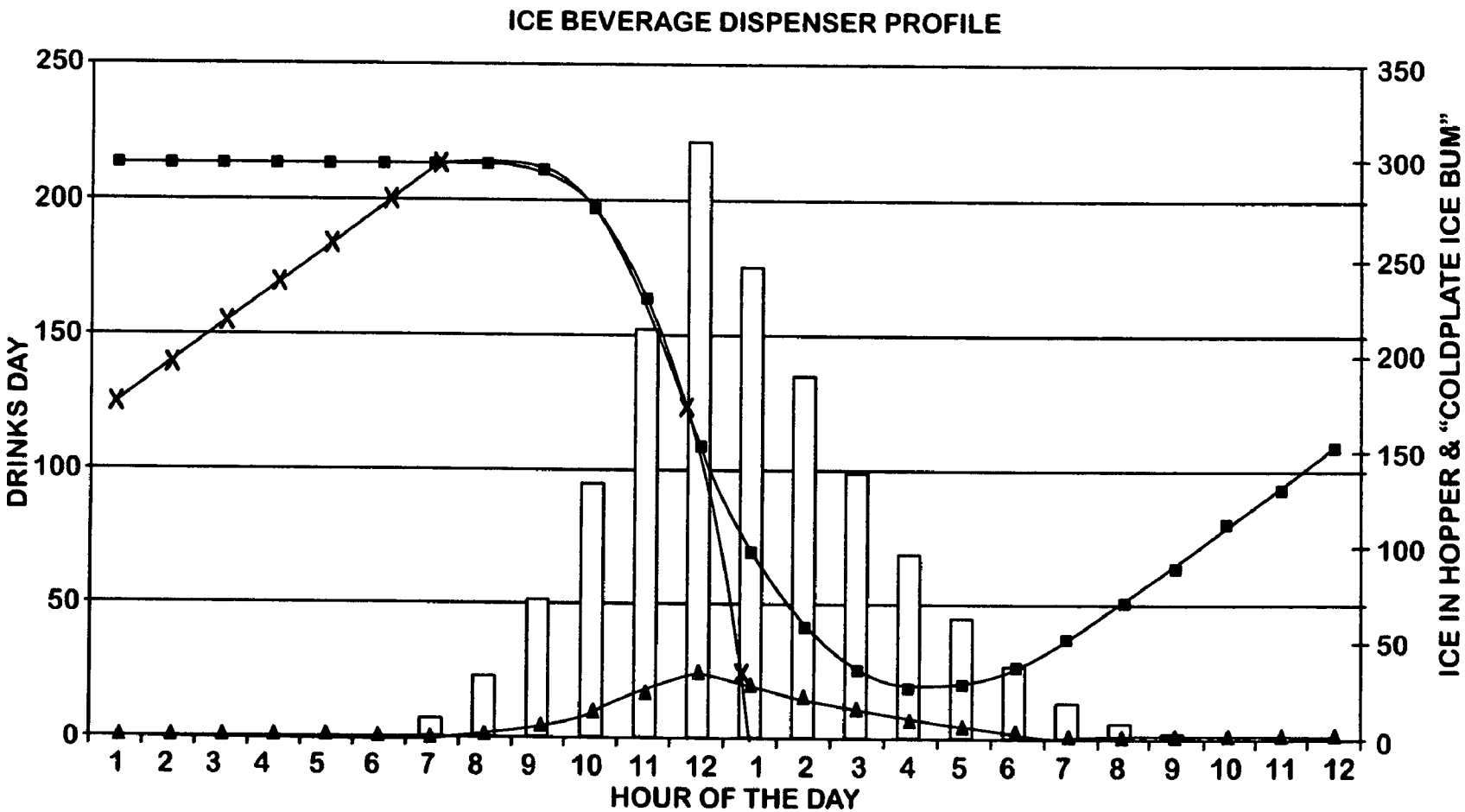
FIG. 10 is a representative ice dispensing profile for an ice/beverage dispenser.

As mentioned, a benefit to matching ice production to ice usage is improved ice quality. Ice is built when it is expected to be used, not when it will simply sit in the ice bin and deteriorate over time. Old ice can be used up without concern of running out, since the electronic control will operate the icemaker to build more ice in a timely fashion to meet upcoming anticipated demands for ice. The result is better quality ice being available to the consumer and less energy being used for ice building. Monitoring of actual ice and drink dispensing by the ice/drink dispenser can be used to develop actual demand profiles(s) for store ice usage, and scheduling of peak demand periods can either be manually programmed into the electronic control or adaptive algorithms can be used to adaptively change scheduling, FIG. 10 shows one example of a load profile for ice demand over a 24-hour period of time as might be encountered in a store, it being understood that there may be wide variations in load profiles for various stores. The demand for ice will be influenced by the hours when the store is open, and the times during the day when demand is high will not be the same for all stores. In the case of the particular load profile shown, peak demand is at noon, with ice usage beginning at about 7 a.m., gradually increasing until 12 p.m. and then gradually decreasing and ending at about 8 p.m. However, there could be other periods when demand increases, such as during late afternoon or early evening hours. In addition, the demand for ice may be different for different days of the week. It may be similar for the five working days each week, but different on Saturday and Sunday, and quite different still on holidays. For days when the load profile changes considerably, a default profile can be chosen for use, rather than allowing the controls to attempt to adapt.

It is important to ensure that the ice/beverage dispenser does not run out of ice during or after the peak demand period. Having knowledge of what the expected demand will be, i.e., knowing the expected ice load profile, it can be determined how far in advance of the beginning of the peak demand period the icemaker needs to start building ice for introduction into the ice bin. When conventional icemaker controls are used, such that building of ice is controlled by the ice level sensors 98*a* and 98*b*, customary practice is to make ice at, fill the bin fully and then let the ice sit in the bin for an extended period of time, during which time the ice deteriorates in quality. In practice of the invention, on the other hand, ice making is initiated in advance of the period of demand for ice, but only so sufficiently far in advance and at a time as will ensure that the bin fills fully with ice at the same time as depletion of ice from the bin begins. As the period of peak ice demand occurs, the ice level in the bin will drop to a minimum level, and as it is important to avoid running out of ice, increasing the ice production rate by utilizing a variable-speed compressor can assist in getting through the peak demand period without running out of ice.

An estimate of a store's ice load profile must be developed to get started. Once an estimate is established, it can be modified manually in accordance with observations or automatically through the use of adaptive algorithms in accordance with actual store ice usage patterns. A contemplated method of adjusting the ice load profile involves measuring the number of drinks dispensed over time, since the number of drinks dispensed during each hour of the day represents the actual drink load profile. For the purpose, it may be necessary to make an assumption about the average drink size, which can vary from 12 oz to 32 oz. Average drink size can be linked to either the actual amount of syrup used or to customer patterns in terms of cups used. As an alternative, the processor based control circuit can keep track of the time intervals over which drinks are dispensed and the numbers of drinks dispensed during the time intervals. This technique can be used to track actual drink volumes, i.e., ounces of drinks served, in addition to the number of drinks dispensed.

A comparison of actual drinks per hour dispensed against the store profile of estimated drinks per hour yields a difference calculation that can be used as a basis for adjusting the ice load profile. To avoid excessive overshooting on a new estimate of the ice load profile, it is contemplated that any adjustment toward the store demand profile be approximately 20% of the difference. This means that up to five observations could be required to confirm a definitive change in usage patterns, but the arrangement would provide stability to an adaptive control strategy.

Figure 5A:
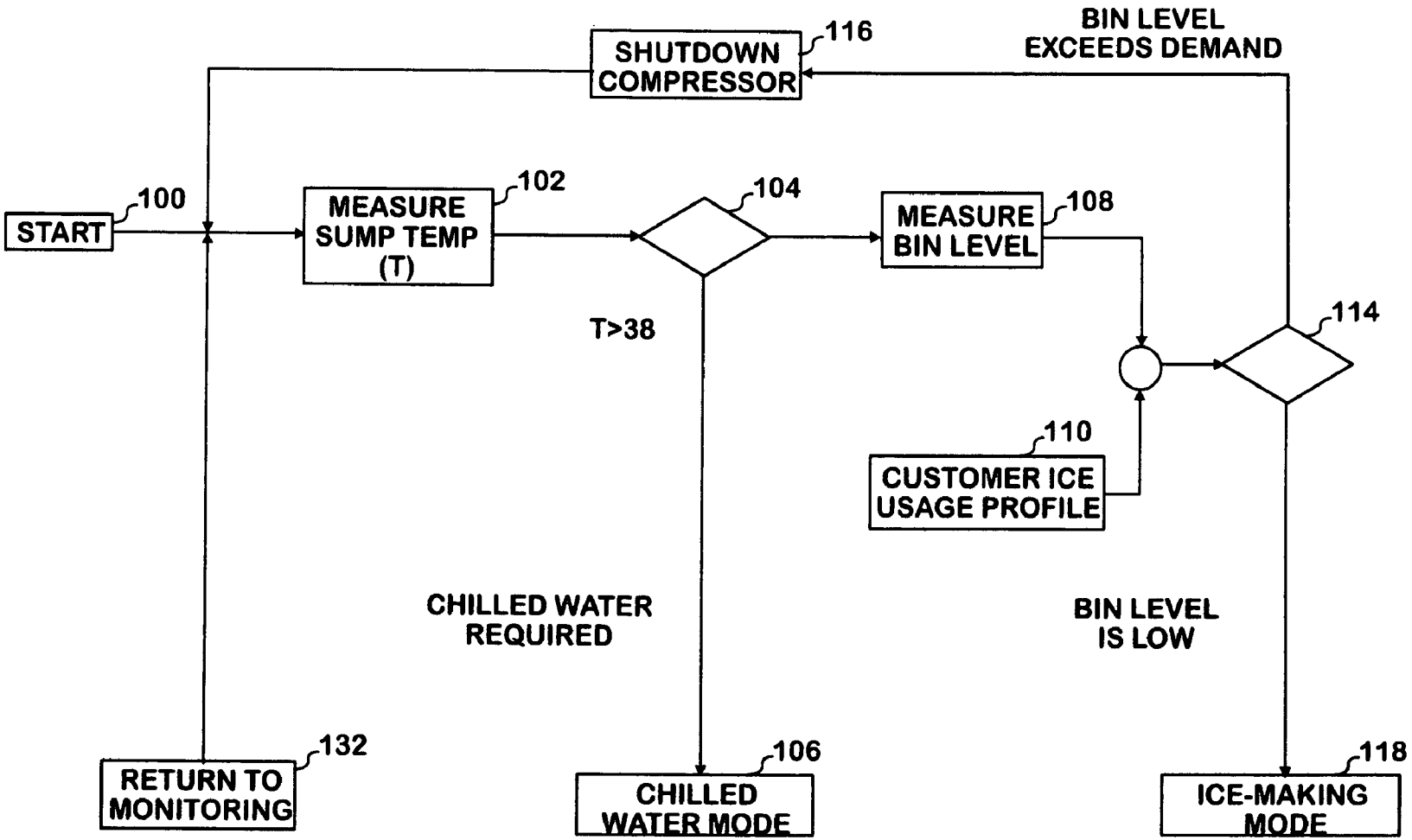
FIG. 5A is a flow chart showing operation of the system in a monitoring mode.
Figure 5B:
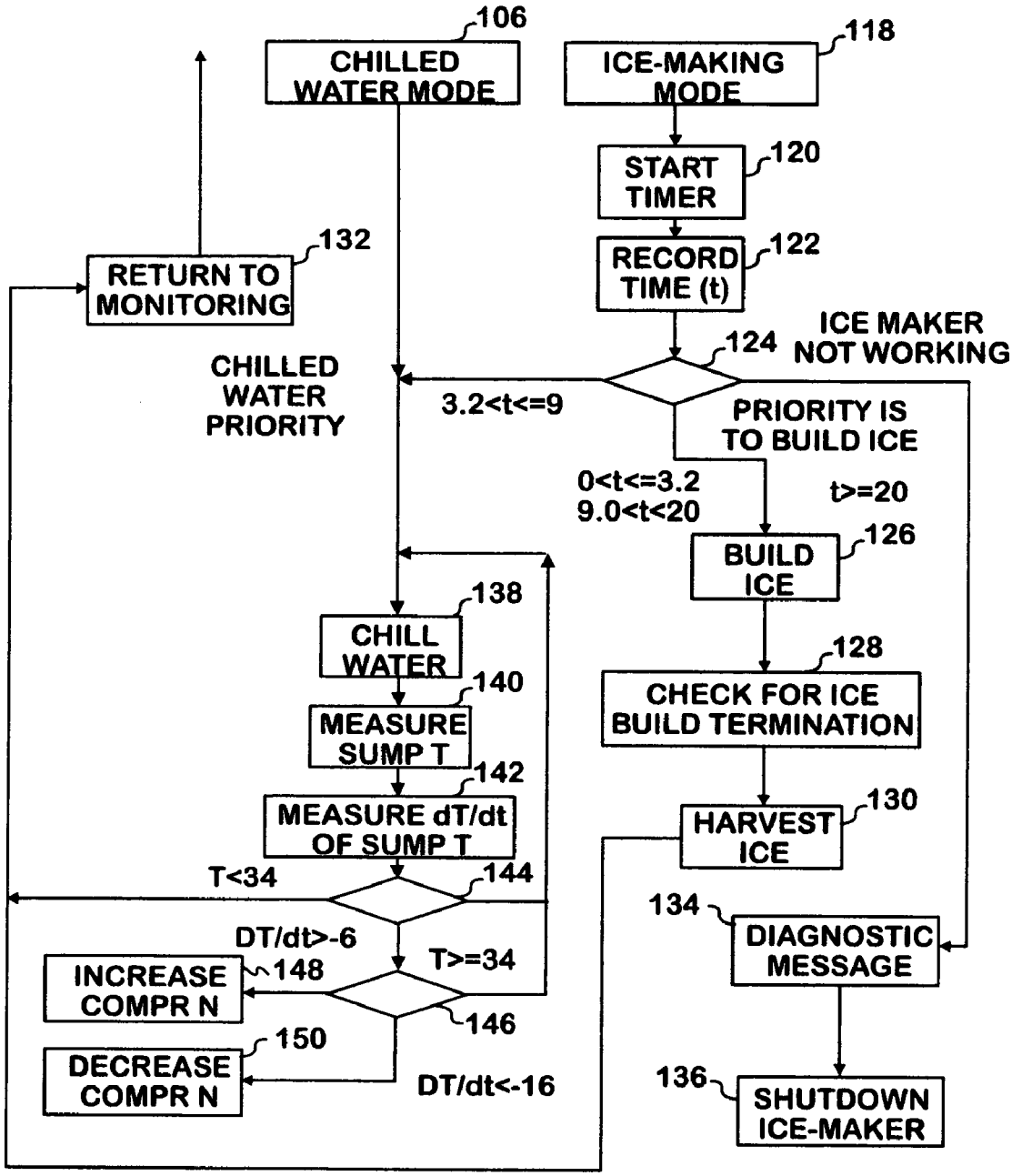
FIG. 5B is a flow chart showing operation of the system in water chilling and ice building modes.
Figure 6:
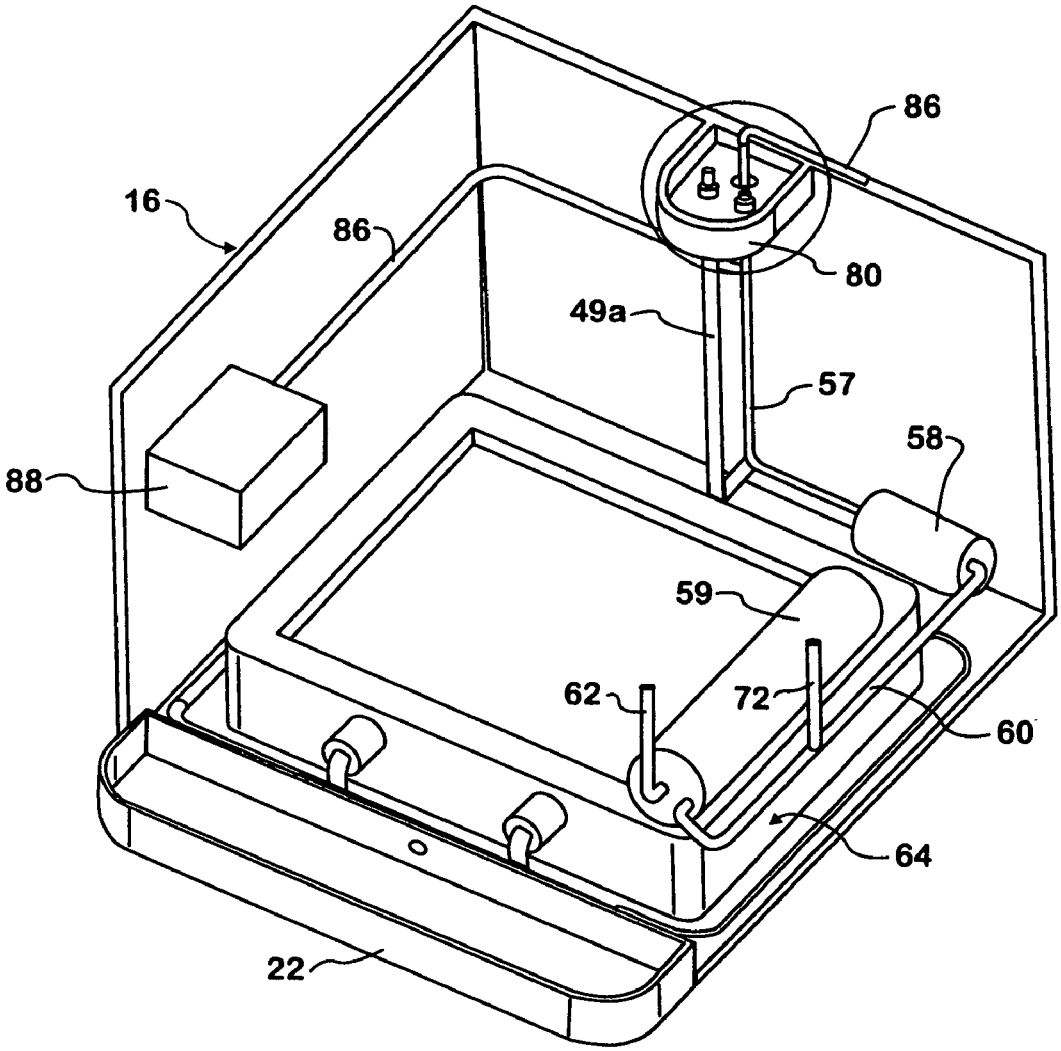
FIG. 6 is a cutaway perspective view of a portion of a cold plate compartment of the ice/beverage dispenser.
Figure 7:
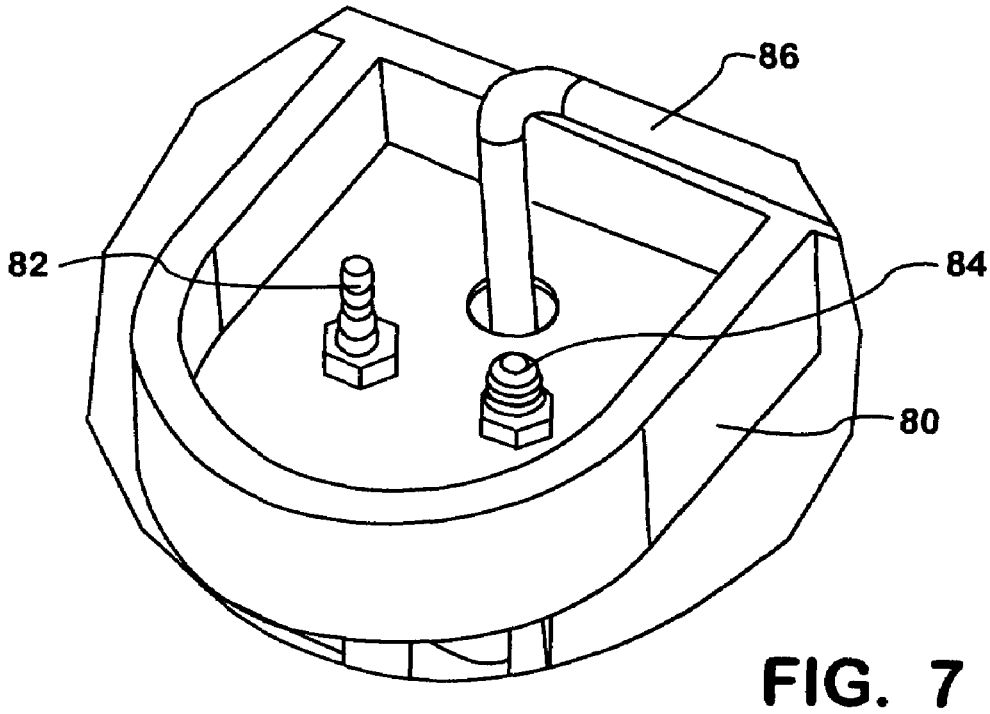
FIG. 7 is an enlarged perspective view of a circled area of FIG. 6, showing a U-shaped tray.
Figure 8:
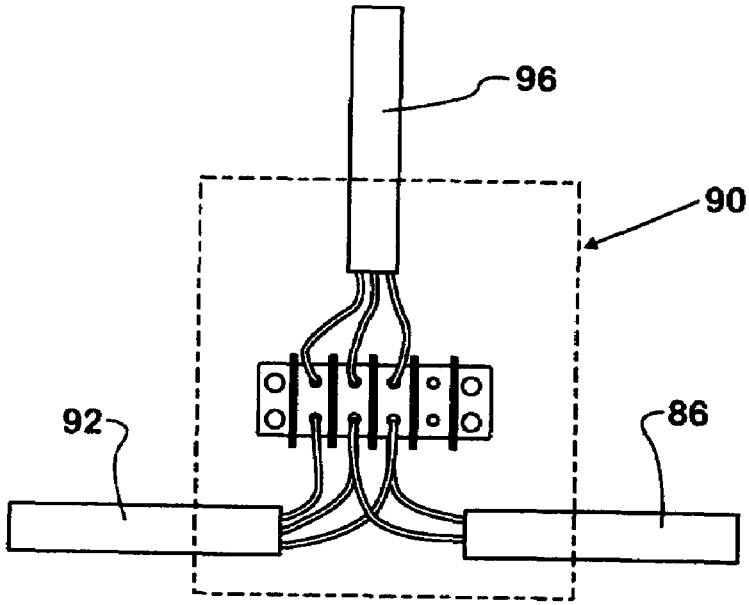
FIG. 8 is an enlarged plan view of an electrical junction box of the machine.

FIGS. 5*a* and 5B show how control of the ice maker is passed between idle, ice making and water chilling states. The microprocessor based control circuit in the junction box 94 responds to sump water temperature information and to ice bin level information. It also responds to time-of-day information from a customer ice usage profile with regard to anticipatory ice building. In addition, the control circuit carries in memory information regarding past ice usage patterns and monitors present and ongoing ice usage patterns so that it can adapt, if and as necessary, to changing patterns.

Referring to the flow diagram of FIG. 5A, which shows a monitoring mode of the control scheme implemented by the control electronics in the junction box 94, and commencing at a start block 100, the control circuit first determines at a block 102 the temperature of water in the sump 40 as detected by the sensor 41. If at a decision block 104 the sensed temperature of water in the sump 40 is above a predetermined upper set point temperature, for example above 38° F., then at a block 106 the system is enabled to enter a water chilling mode, depending upon the time elapsed since the beginning of any then occurring ice making cycle. Upon entering the water chilling mode, the system remains in that mode until the sensed temperature of water in the sump 40 is reduced to a lower set point temperature, for example 34° F., whereupon the system returns to the start block 100. On the other hand, if at the block 104 the sensed temperature of water in the sump 40 is no greater than the predetermined upper set point temperature, then at a block 108 the level of ice in the ice bin 66 is sensed, as detected by the bin ice level sensors 98*a* and 98*b*. The sensed level of ice in the bin 66 and customer ice usage profile information at block 110, as derived from the electronic control, are provided through a gate 112 to a decision block 114. If at the block 114 it is determined that the ice bin is full, then irrespective of any demand for ice indicated by the customer ice usage profile, at a block 116 the icemaker compressor 26 is turned off or, if already off, remains off. Also, if at the block 114 it is determined that the ice bin is not full but nevertheless contains at least a predetermined minimum level of ice, and if at that time the customer usage profile does not indicate a demand to build of ice, again at the block 116 the icemaker compressor 26 is turned off or, if already off, remains off. However, if at the block 114 it is determined that the bin 66 is less than full and the customer ice usage profile at block 110 indicates a demand for the building of ice, then at a block 118 the system is enabled to enter an ice making cycle. Also, if at the block 114 it is determined that the level of ice in the bin 66 is less than a predetermined minimum level, for example the bin is less than 33% full, again at block 118 the system is enabled to enter an ice making cycle until the bin is filled with ice to the predetermined minimum level, irrespective of any indication then being provided by the customer ice usage profile at block 110 that ice is not to be built.

As seen in FIG. 5B, upon the icemaker and ice/beverage dispenser entering an ice making cycle at the block 118, at the beginning of the cycle a timer is started at a block 120 and the time duration of the cycle is recorded at a block 122. The recorded time is presented at a decision block 124 and at a block 126 ice making is commenced. The ice thickness sensor 99 is checked at a block 128, and if ice on the evaporator 30 is sufficiently thick and ready for harvest, a hot refrigerant gas ice harvest is initiated at a block 130. Upon completion of ice harvest, at a block 132 the system returns to monitoring, as seen in FIG. 5A.

Should it happen at the block 124 that the icemaker remains in the same ice making cycle for the duration of a maximum predetermined time, such as for 20 minutes, that is beyond the time the ice making cycle should have ended if the ice making cycle proceeded properly, it is assumed that a failure has occurred and at a block 134 a diagnostic message is generated and at a block 136 the icemaker is shut down.

If at the block 104 the sensed temperature of the water in the sump 40, as detected at the block 102, is greater than the upper set point temperature, e.g., 38° F., then irrespective of the sensed level of ice in the ice bin at the block 108, at the block 106 the system enters the water chilling mode since the temperature of water in the sump must be lowered as the water is not sufficiently cold to be mixed with syrup and produce a drink of a desired low temperature. Under the circumstance where the system enters the water chilling mode, at the block 122 the time elapsed from initiation of any current ice making cycle is determined. If at the block 124 the time elapsed since a current ice-making cycle began is less than a predetermined minimum time required to initiate a minimum ice formation level on the evaporator ice panel 32, which minimum time may be on the order of 3.2 minutes, then the ice making cycle in progress is not interrupted. In other words, if the refrigeration system is less than about 3.2 minutes into a current ice building cycle, ice of at least a minimum sufficient thickness will not have formed on the evaporator ice panel 32 and ice building is allowed to continue. When the minimal sufficient thickness of ice on the ice panel 32 is reached, as determined at the block 122 by the refrigeration system being in the current ice-making cycle for at least the predetermined minimum time, at the block 124 the refrigeration system is switched to water chilling mode and at a block 138 water chilling, begins, wherein both sides of the evaporator 30 are used for the purpose of water chilling in order to decrease the temperature of water in the sump 40. The reason for waiting for the refrigeration system to be into the current ice-making cycle for at least the predetermined minimum time before switching to water chilling, is because if ice being formed on the ice panel 32 is not of at least a minimum sufficient thickness, the efficiency of the refrigeration system in water chilling mode will decrease.

On the other hand, if the time elapsed in any current ice making cycle is greater than the predetermined minimum time required for ice building to be well-initiated, then priority can be given to determining whether cooling of the water in the sump 40 can be immediately commenced. This determination also is made based upon the time recorded at the block 122, and if the time recorded is determined at the block 124 to be at least a predetermined maximum time that is long enough that the current ice making cycle is well underway, the ice making cycle is allowed to proceed to harvesting of ice. However, if the time recorded is determined at the block 114 to be greater than the minimum predetermined time but no greater than the maximum predetermined time, then ice making is interrupted and at a block 138 water chilling is begun. Thus, three ice building time periods are considered at the block 124: (1) a minimum time period beginning at commencement of the current ice making cycle and ending at the predetermined minimum time and during which ice building is allowed to continue; (2) a midrange time period extending from the predetermined minimum time to the predetermined maximum time and during which water chilling can be immediately commenced, and (3) a maximum time period beginning at the predetermined maximum time and during which ice making is allowed to continue to harvest. For example, if the midrange time period beginning with initiation of the current ice-making cycle is established to be on the order of between 3.2 and 9 minutes, then should the time period determined at the block 124 be less than 3.2 minutes, ice building is allowed to continue until 3.2 minutes is reached before water chilling begins; should the time period be between 3.2 and 9 minutes, ice making is terminated and water chilling is immediately commenced, and should the time period be at least 9 minutes, then ice harvest should be imminent and the current ice making cycle is allowed to continue to conclusion However, if the time recorded at the block 122 and determined at the block 124 is at least equal to 20 minutes, it is an indication that there may be something wrong with the ice making cycle, in which case a diagnostic message is given at the block 134 and an icemaker shut down is effected at the block 136.

If the time recorded at the block 122 is in the midrange, or if it is zero, indicating that there is no current ice making occurring, then at the decision block 124 the control system moves to block 138 and the pump 44 is turned on and the valve 48 is opened to chill the water in the sump 40 by delivering the water to and flowing the water over the ice cube forming panel 32 and the water chilling panel 34 on opposite sides of the evaporator 30 while the refrigeration system is operated to cool the evaporator. This cooling technique uses the evaporator 30 to a higher level of efficiency by substantially doubling its effective heat exchange surface area. While water chilling is occurring, the temperature of water in the sump 40, as detected by the sensor 41, is sensed at a block 140 and at a block 142 a determination is made of the rate of change of the sump water temperature with respect to time. At a decision block 144 the sensed temperature of the sump water is compared with the lower set point temperature, and when the temperature of the water decreases to the lower set point temperature, e.g., to 34° F., the pump 44 is turned off, the valve 48 is closed and at the block 132 the control system returns to monitoring mode (FIG. 5A). The lower set point temperature for water in the sump 40 is selected to be above 32° F., so that during water chilling the water does not begin to freeze on the water chilling plate 34.

Advantageously, the compressor 26 is of the variable speed type and is controlled to operate at different levels, depending upon the degree of cooling required. In this manner, during ice making the compressor can be controlled to pull the evaporator 36 down to a temperature of around 0° F. while during water chilling the evaporator temperature can be pulled down to only about 25° F. to insure that ice does not form on the water chilling plate 34. At a decision block 146 a determination is made whether the temperature of the water in the sump 40 is being reduced at a sufficient rate, such as by at least 6° F. per minute and, if it is not, then at a block 148 the compressor speed is increased incrementally, for example by 10%. Conversely, if the rate of cooling of the water exceeds a maximum desired rate of temperature decrease, for example is greater than about 16° F. pr minute, then at a block 150 the compressor speed is decreased incrementally, for example by 10%. Should the rolling average for the rate of cooling of the water be positive, then it is contemplated that compressor speed be increased by about 20%. The rate of change of sump water temperature with respect to time is thereby maintained in a desired intermediate range.

The dispenser components must be sized appropriately, so that the system will be able to meet the user ice usage profile. If, by way of example, the icemaker and ice/beverage dispenser 10 is to be capable of delivering four twelve ounce drinks per minute for a total of 120 drinks at a desired temperature of below 40° F., that requirement impacts the sizing of the compressor 26 and the evaporator 30 and the size or capacity of the sump 40. It is desirable that the refrigeration system be sized not only to avoid short cycling of the compressor, but also to avoid continuous operation as well. In other words, the refrigeration system should have some built in excess capacity. In a system with a variable speed compressor and an ice making capacity of approximately 500 pounds per day, and given the above stated cold drinks volume capacity, a sump volume of approximately three gallons would be required and a refrigeration system capacity in the range of about 9,350 to 13,200 Btu/hr would be needed. It is understood, of course, that the particular sizing chosen for the various components is dependent upon the customer ice usage profile and the performance criteria to be met by the dispenser 10.

While the invention has been described in detail, various modifications and other embodiments thereof can be devised by one skilled in the art without departing from the spirit and scope of the invention, as defined in the accompanying claims.

What is claimed is:

1. An ice making and dispensing system, comprising:

an ice dispenser having an ice retaining bin and means for sensing the level of ice in said bin;

an icemaker for making and introducing ice into said bin; and a control system responsive to the sensed level of ice in said bin and to a demand for ice being provided by an adaptive ice usage profile of said ice dispenser, wherein the demand for ice is representative of an anticipated upcoming usage of ice from said ice dispenser and is modified in accordance with prior usages of ice from said ice dispenser, to operate said icemaker, if and as necessary, to introduce into said bin sufficient ice to meet the anticipated upcoming usage of ice from said ice dispenser.

2. A system as in claim 1, wherein said ice usage profile provides demands for ice in accordance with days and times of day when usage of ice is anticipated to occur and said control system is responsive to the sensed level of ice in said bin and to demands for ice provided by said ice usage profile to operate said icemaker, if and as necessary, to introduce into said bin sufficient ice to meet anticipated usages of ice at such days and times of day.

3. A system as in claim 1, wherein said control system may be manually programmed to include a desired ice usage profile.

4. A system as in claim 1, including means for monitoring usage of ice from said ice dispenser, and wherein said ice usage profile is responsive to said monitoring means to adaptively change the demand for ice provided by said ice usage profile in response to changes in the monitored usage of ice from said ice dispenser.

5. A system as in claim 1, wherein said control system, in response to sensing that said bin is full of ice and irrespective of any demand for ice then being provided by said ice usage profile, turns said icemaker off if said icemaker is then being operated to introduce ice into said bin or, if said icemaker is already off, maintains said icemaker off.

6. A system as in claim 1, wherein said control system, in response to sensing that said bin is less than full of ice but contains at least a predetermined minimum level of ice and in the absence of a demand for ice then being provided by said ice usage profile, turns said icemaker off if said icemaker is then being operated to introduce ice into said bin or, if said icemaker is already off, maintains said icemaker off.

7. A system as in claim 1, wherein said control system, in response to sensing that said bin is less than full and to a demand for ice then being provided by said ice usage profile, operates said icemaker to introduce ice into said bin.

8. A system as in claim 1, wherein said control system, in response to sensing that said bin contains less than a predetermined minimum level of ice and in the absence of a demand for ice then being provided by said ice usage profile, operates said icemaker to introduce ice into said bin until said bin is filled with ice to said predetermined minimum level.

9. A method of operating an ice dispensing system that includes an ice dispenser having an ice retaining bin and an icemaker for introducing ice into the bin, said method comprising the steps of:

sensing the level of ice in the bin;

generating an adaptive ice usage profile for the ice dispenser, the ice usage profile providing demands for ice that are representative of anticipated upcoming usages of ice from the ice dispenser and that are modified in accordance with prior usages of ice from said ice dispenser; and operating the icemaker, if and as necessary, in response to a demand for ice being provided by the ice usage profile, to introduce into the bin sufficient ice to meet an anticipated upcoming usage of ice.

10. A method as in claim 9, wherein said generating step comprises generating an ice usage profile that provides demands for ice representative of days and times of day when usage of ice from the ice dispenser is anticipated to occur, said operating step operating the icemaker, if and as necessary, in response to demands for ice being provided by the ice usage profile, to introduce into the bin sufficient ice to meet the anticipated upcoming usages of ice at such days and limes of day.

11. A method as in claim 9, wherein said generating step may be performed by manually generating a desired ice usage profile.

12. A method as in claim 9, including the step of monitoring usage of ice from the ice dispenser, said generating step being responsive to said monitoring step to adaptively change the ice usage profile in accordance with the monitored usage of ice.

13. A method as in claim 9, including the step, in response to said sensing step sensing that the bin is full of ice and irrespective of any demand for ice then being provided by the ice usage profile, of controlling said operating step to turn the icemaker off if the icemaker is then being operated to introduce ice into the bin or, if the icemaker is already off, to maintain the icemaker off.

14. A method as in claim 9, including the step, responsive to said sensing step sensing that the bin is less than full of ice but contains at least a predetermined minimum level of ice and in the absence of a demand for ice then being provided by the ice usage profile, of controlling said operating step to turn the icemaker off if the icemaker is then being operated to introduce ice into the bin or, if the icemaker is already off, to maintain the icemaker off.

15. A method as in claim 9, wherein said operating step, in response to said sensing step sensing that the bin is less than full of ice and to a demand for ice then being provided by the ice usage profile, operates the icemaker to introduce ice into the bin.

16. A method as in claim 9, wherein said operating step, in response to said sensing step sensing that the bin contains less than a predetermined minimum level of ice and in the absence of a demand for ice then being provided by the ice usage profile, operates the icemaker to introduce ice into the bin until the bin is filled with ice to the predetermined minimum level.

* * * * *

UNITED STATES PATENT AND TRADEMARK OFFICE

CERTIFICATE OF CORRECTION

PATENT NO. : 7,415,833 B2
APPLICATION NO. : 11/199529
DATED : August 26, 2008
INVENTOR(S) : Daniel C. Leaver and Thaddeus M. Jablonski It is certified that error appears in the above-identified patent and that said Letters Patent is hereby corrected as shown below:

Column 15, line 23, “limes” should be --times--

Signed and Sealed this

Eighteenth Day of November, 2008

JON W. DUDAS
*Director of the United States Patent and Trademark Office*